United States Patent [19]

Beck et al.

[11] Patent Number: 4,838,714

[45] Date of Patent: Jun. 13, 1989

[54] NEEDLE PRINT HEAD

[75] Inventors: Herbert Beck; Karl-Heinz Anton; Harald Homner, all of Paderborn, Fed. Rep. of Germany

[73] Assignee: Nixodorg Computer AG, Paderborn, Fed. Rep. of Germany

[21] Appl. No.: 156,833

[22] Filed: Feb. 17, 1988

[30] Foreign Application Priority Data

Mar. 2, 1987 [DE] Fed. Rep. of Germany ..... 3706730

[51] Int. Cl.[4] ..... B41J 3/10

[52] U.S. Cl. ..... 400/124; 400/174; 101/93.04

[58] Field of Search ..... 400/124, 174; 101/93.04, 93.05

[56] References Cited

U.S. PATENT DOCUMENTS

| | | | |
|---|---|---|---|
| 3,842,955 | 10/1974 | Iwasaki | 400/124 |
| 4,167,343 | 9/1979 | Golobay | 101/93.04 X |
| 4,175,076 | 11/1979 | Hanaoka | 400/124 |
| 4,320,981 | 3/1982 | Harrison et al. | 101/93.05 X |
| 4,396,304 | 8/1983 | Davenport et al. | 400/124 |
| 4,634,305 | 1/1987 | West et al. | 400/124 |
| 4,652,158 | 3/1987 | Asani et al. | 400/124 |
| 4,653,943 | 3/1987 | Sakaido et al. | 400/124 |
| 4,737,042 | 4/1988 | Hayashi et al. | 400/124 |

*Primary Examiner*—Edgar S. Burr
*Assistant Examiner*—James R. McDaniel

[57] ABSTRACT

In a needle print head including a plurality of hinged armature magnets arranged in a ring about a needle guide with each of the magnets including a U-shaped magnet yoke, a magnet coil on one of the U-legs of such yoke and a hinged armature arranged at least nearly radially, the hinged armature at its radially inner end is connected to a print needle and is biased by spring force to a rest position away from the yoke at which it engages a stop, each hinged armature at its radially outer end being pivotally supported by a cylindrical pin for rotation about the axis of the pin, and a return spring engaging the hinged armature at a point between the print needle and the radially inner yoke leg.

7 Claims, 1 Drawing Sheet

NEEDLE PRINT HEAD

BACKGROUND OF THE INVENTION

The invention concerns a needle print head including a plurality of hinged armature magnets arranged in a ring about a needle guide with each magnet having a U-shaped magnet yoke, a magnet spool surrounding one of the U-legs of the magnet yoke and an at least nearly radially directed hinged armature, which armature at its radially inner end is rigidly connected to a print needle and is biased by spring force to a rest position away from the yoke at which it engages a stop.

In one needle print head of the previously described type, as known from DE-OS No. 27 17 007, the hinged armature is suspended at its radially outer end from a spring hanger and lays on the radially outer yoke leg so as to be pivotal on the radially outer edge of the yoke leg surface which faces it. A first disadvantage of this arrangement is that the yoke leg and the hinged armature which engages it, upon the movement of the armature, rub against one another so that a relatively strong and indefinite wear of the coengaging surfaces occurs. As a result of this, after a long operating time the quality of the print made by such a needle print head changes. According to DE-OS No. 29 43 440 an attempt has already been made to avoid this disadvantage in that the hinged armature does not pivot on an edge of the magnet yoke but instead rolls on a cylindrical pin. However, in practice it is found that in this case a pure rolling motion does not occur since the spring hanger, from which the hinged armature is suspended, causes also a slight translational movement of the hinged armature. In the case of both of these known hinged armature magnets the hinged armatures are moreover formed as two armed levers with a lever ratio of about 1:20. This large lever ratio means that no only the forces, but also the mechanical tolerances in the area of both lever arms or at the two ends of the lever arms stand in the same ratio to one another. A wear of a few one-hundredths of millimeters in the area of the armature support results in a considerably larger change in displacement at the end of the armature carrying the print needle. Hence, even with new hinged armature magnets considerable variation in the striking force with which the print needle operates on the print carrier can appear.

A further hinged armature magnet for a printer is known from U.S. Pat. No. 4,202,638 in which the hinged armature at its end opposite from the print end is fastened to a leaf spring. The hinged armature in this case lies in its rest position on the magnet yoke so that the hinged armature under the effect of the leaf spring strikes onto the print carrier. With this arrangement indeed no abrasion appears in the support area of the hinged armature, however the support axis of the hinged armature is not well defined. Besides the striking force achieved through the spring is insufficient in the case of multiple-layered print-through forms to achieve a printing of good quality on the lowermost sheet.

In a hinged armature for a needle print head known from GB-A No. 2,035,905 the hinged armature is supported on a yoke leg about a fixed pivot axis with a return spring engaging its short lever arm remote from the print needle. Because of this unfavorable lever ratio the hinged armature likewise has the above discussed disadvantages. Moreover, in this arrangement the hinged armature is not rigidly connected with the print needle but instead strikes onto the print needle which is biased to its rest position by its own return spring. Since the print needle on one hand and the hinged armature on the other hand represent two oscillating systems, which do not have oscillations of identical size, the two oscillating systems can at some drive frequencies come to a distinctly different oscillating relationship. This can lead on one hand to an increased wear of the print needle and of the hinged armature and on the other hand can lead to the creation of shadow pictures.

The invention has as its object the provision of a needle print head of the previously described type which is simple to manufacture and to assemble, which has a long service life, which makes possible a high drive frequency and which also in the case of print-through forms guarantees a clean printed picture of all layers of the form without the creation of shadow pictures.

This object is attained in accordance with the invention in that the hinged armature is supported at its radially outer end by means of a cylindrical pin for pivotal movement about the axis of the pin and that the cylindrical pin is snapped into support forks located on both sides of the radially outer yoke leg, which support forks are made of plastic and have fork legs enclosing between themselves a partially cylindrical support surface extending for more than 180°.

In the needle print head of the invention the hinged armature has a spatially fixed and definite pivot axis. The cylindrical pin can be made very precisely by simple means. The coengaging bearing surfaces for the pin which are formed on one hand by the pin and on the other hand by a receiving bearing part made of plastic are subject to small wear, which wear moreover occurs for all of the hinged armatures in at least nearly the same degree and in the same way. The elasticity of the plastic makes possible a snapping in of the pins. Therefore, the hinged armatures can be assembled without the need for great care. At the same time the plastic assures a small wear of the support pin. Moreover, the support forks can be made in a simple way and with high precision as injection molded parts. Preferably, a return spring engages the hinged armature at a point lying between the print needle and the radially inner yoke leg. Since in accordance with the invention the hinged armature is formed as a one-armed lever and the return spring engages the hinged armature at a point relatively far from the bearing axis, tolerances in the spring strength or in the spacing of the engagement point of the spring on the hinged armature from the bearing axis have little effect on the striking force of the print needle. Therefore, in the case of the arrangement of the invention the striking forces of different new hinged armatures lie in a relatively narrow tolerance range. Accordingly, the needle print head of the invention delivers a printed picture of very good quality. Because of the arrangement of the return spring relatively near to the print needle the rebound of the hinged armature on the stop is reduced, so that the danger of creating shadow pictures at high operating frequencies is avoided.

The fastening of the support forks to the magnet yoke can be accomplished in a simple way by having the support forks connected to one another through a metal bar which is fastened to the radially outer yoke leg as, for example, by spot welding.

The return spring is preferably a helical compression spring which on one side engages a plate carrying the magnet yoke and which on its other side engages the associated hinged armature, the helical compression spring advantageously being guided in a tube and, for reducing the friction between the spring and the hinged armature, carrying at its end facing the hinged armature a ball received in a corresponding recess in the hinged armature.

In order to permit adjustment of the excursion of the hinged armature it is advantageous if all of the hinged armatures are adjustable in the direction of movement of the print needles by a common stop. For dampening the rebound the stop can carry, on its side facing the hinged armatures, a layer of suitable dampening material.

Along with the already mentioned advantages the support for the hinged armature provided by the invention in comparison with a support of the hinged armature by a spring has the advantage that it allows a definite air gap between the hinged armature and the magnet yoke to be precisely maintained. In this way a sticking of the hinged armature to the magnet yoke can be dependably prevented.

Further features and advantages of the invention will be apparent from the following description, which in connection with the accompanying drawings explain the invention in connection with a preferred embodiment.

DESCRIPTION OF THE PREFERRED EMBODIMENT

Figure 1:
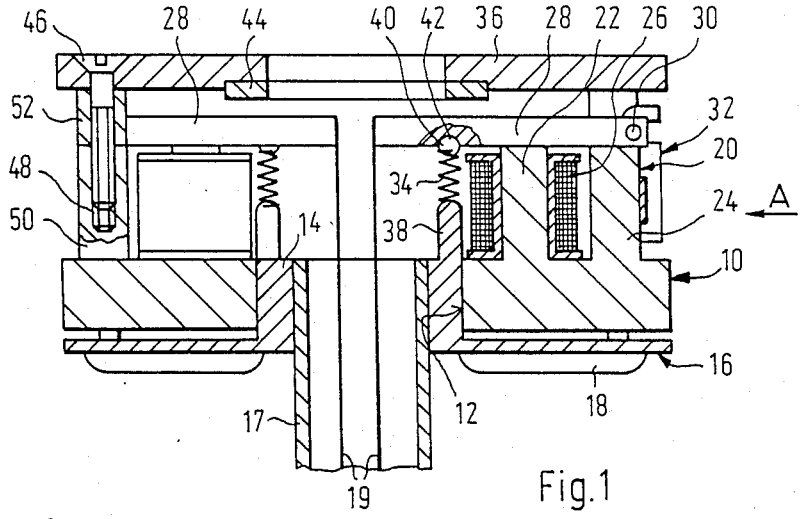
FIG. 1 a schematic section through a print head embodying the invention taken on a plane running parallel to the print needles, which section on the right half of FIG. 1 passes through a hinged armature magnet and in the left half of FIG. 1 passes between two neighboring hinged armature magnets, FIG. 2 a schematic view of a hinged armature magnet taken in the direction of the arrow A of FIG. 1, and FIG. 3 an enlarged perspective view of the support parts for receiving the cylindrical pin for the hinged armature.

The needle print head illustrated schematically in FIG. 1 includes a circular disc-shaped yoke plate, indicated generally at 10, with a central recess 12 in which a tubular central part 14 of a disc-shaped cooling body 16 extends, the yoke plate 10 being fastened to the cooling body 16 and the cooling body having cooling ribs 18 on the side turned away from the yoke plate 10. A schematically represented mouthpiece or guide piece 17 is held in the part 14 for guiding print needles 19.

The yoke plate 10 on its side turned away from the cooling body 16 carries in circular arrangement about the central recess 12 a plurality of hinged armature magnets 20. Each of these hinged armature magnets includes two yoke legs 22, 24 arranged adjacent to one another in the radial direction, formed of one piece with the yoke plate 10 and extending perpendicular to the yoke plate 10. The radially inner yoke leg 22 carries an associated magnet coil 26. The magnetic circuit is completed by a generally radially directed hinged armature 28 which on its inner end is fastened to a pressure needle 19. At its radially outer end the hinged armature 29 carries a cylindrical pin 30 supported in a bearing part indicated generally at 32 and fastened to the radially outer yoke leg 24, as explained in more detail by reference to FIGS. 2 and 3. Thus, the hinged armature 28 is pivotal about the axis of the cylindrical pin between a print position near the yoke legs as illustrated in FIG. 2 and another position away from the yoke legs and toward which it is urged by a helical compression spring 34 and in which position it engages an annular stop 36.

The helical compression spring 34 with one of its ends engages a peg 38 formed of one piece with the yoke plate. At the end facing the hinged armature 28 the helical compression spring 34 carries a ball 40 which is received in a half-spherical recess 42 in the underside of the hinged armature 28 so as to lessen the friction between the spring 34 and the armature 28.

The stop 36 carries, on its side turned toward the hinged armature 28, a ring 44 made of a material for dampening the impact of the hinged armature, so as to hinder the rebound of the armature 28 from the stop 36. The circular disc-shaped stop 36 is fastened to the yoke plate 10 with the help of screws 46 received in threaded bores 48 formed in projections 50 formed of one piece with the yoke plate 10. With the help of spacing sleeves 52 receiving the screws 46 the spacing of the stop 36 from the yoke plate 10 and thereby the pivotal excursion of the hinged armatures 28 can be exactly adjusted.

Figure 2:
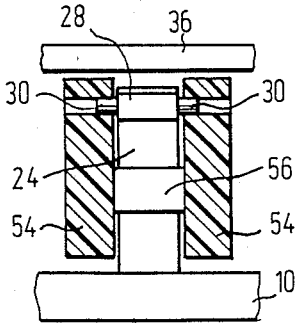
Figure 3:
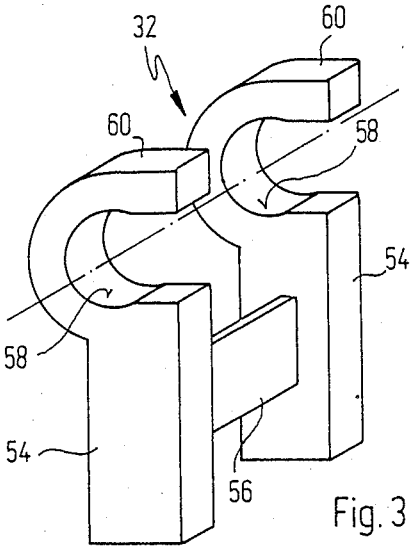

The support part 32, according to FIGS. 2 and 3, has two support forks 54 made of plastic which are connected to one another by a metal bar 56, the two forks having a spacing from one another which corresponds generally to the width of the yoke leg 24. The metal bar 56 is for example fastened to the radially outwardly directed face of the yoke leg 24 by spot welding so that the two support forks 54 are positioned on both sides of the yoke leg 24 as can be seen in FIG. 2.

The support forks 54 have radially outwardly directed fork openings and in communicating with such openings define for each fork a partially cylindrical support surface 58 which extends over slightly more than 180°. Therefore, the opening width of the fork openings is slightly smaller than the diameter of the cylindrical pin 30 matching the support surfaces 58. Upon pressing the cylindrical pin 30 into the support forks 54 the free fork legs 60 are thereupon elastically deflected and held in such deflected position until the snapping of the cylindrical pin 30 into the support surface 58, so that the pin 30 cannot move by itself out of the support forks 54.

It has been shown that a printing head with hinged armature magnets of such design achieves a long service life with printed graphics of high-class quality. Also, at high operating frequencies it produces no shadow pictures and because of the high obtainable striking force of the printing needles is suited to the printing of multilayered print-through forms.

We claim:

1. A needle print head including a plurality of hinged armature magnets arranged in a ring about a needle guide with each of said magnets having a U-shaped magnet yoke having legs, a print needle, a spring means, a stop, an insertable and removable cylindrical pin, support forks located on both sides of a yoke leg, a magnet coil surrounding one of the legs of the magnet yoke and an at least nearly radially directed hinged armature including inner and outer ends and is rigidly connected at its radially inner end with the print needle and is biased by the spring means to a rest position remote from the yoke at which it engages the stop, characterized in that the hinged armature is supported at its radially outer end by means of the cylindrical pin for pivotal movement about the axis of the pin such that the cylindrical pin is supported by the support forks located on both sides of the radially outer yoke leg, the support forks being made of plastic and including U-shaped fork legs enclosing between themselves a partially cylindrical support surface extending for slightly more than 180° so that during assembly of said pin with said fork legs said pin may be pushed sideways into engagement with said support surfaces of said forks with said fork legs of each fork elastically deflecting during such assembly to provide a snap action reception of said pin whereby after such assembly said pin is held by said fork legs in engagement with said support surfaces and against movement by itself from said forks.

2. A needle print head according to claim 1 further characterized in that the support forks are connected with one another by a metal bar which is fastened to the radially outer yoke leg.

3. A needle print head according to claim 1 further characterized in that a return spring engages the hinged armature at a point lying between the print needle and the radially inner yoke leg.

4. A needle print head according to claim 3 further characterized in that the return spring is a helical compression spring which on one side engages a plate carrying the yoke legs and on the other side engages the associated hinged armature.

5. A needle print head according to claim 4 further characterized in that the helical compression spring on its end facing the hinged armature carries a ball which is received in a corresponding recess in the hinged armature.

6. A needle print head according to claim 1 further characterized in that all of the hinged armatures are adjustable in the direction of the movement of the printing needles by a common stop.

7. A needle print head according to claim 1 further characterized in that the stop on its side facing the hinged armatures carries a layer of a material dampening the rebound of the hinged armatures.

* * * * *